US008156674B2

(12) United States Patent
Martinez, Jr.

(10) Patent No.: US 8,156,674 B2
(45) Date of Patent: Apr. 17, 2012

(54) FRAME BLOCK FOR FLAT RECTANGULAR PLANAR OBJECTS SUCH AS PHOTOGRAPHS

(76) Inventor: Sergio Eduardo Martinez, Jr., Washington, DC (US)

( * ) Notice: Subject to any disclaimer, the term of this patent is extended or adjusted under 35 U.S.C. 154(b) by 159 days.

(21) Appl. No.: 12/603,173

(22) Filed: Oct. 21, 2009

(65) Prior Publication Data

US 2011/0088303 A1 Apr. 21, 2011

(51) Int. Cl.
*A47G 1/16* (2006.01)

(52) U.S. Cl. ..... 40/764; 40/618; 40/798; 40/735

(58) Field of Classification Search ..... 40/764, 40/700, 618, 798, 799, 735, 568, 585
See application file for complete search history.

(56) References Cited

U.S. PATENT DOCUMENTS

| | | | | | |
|---|---|---|---|---|---|
| 1,315,077 | A * | 9/1919 | Barclay | | 40/618 |
| 2,306,511 | A * | 12/1942 | Wagner | | 40/576 |
| 2,682,125 | A * | 6/1954 | Coffield | | 40/618 |
| 2,966,754 | A * | 1/1961 | Orkin | | 40/618 |
| 4,685,647 | A * | 8/1987 | Calhoun | | 248/444.1 |
| 4,722,147 | A * | 2/1988 | Gieske et al. | | 40/618 |
| 4,899,474 | A | 2/1990 | Piana et al. | | |
| D329,942 | S | 10/1992 | Carr | | |
| 5,347,738 | A * | 9/1994 | Zweig et al. | | 40/721 |
| D382,017 | S * | 8/1997 | Bohr et al. | | D20/10 |
| 7,249,430 | B2 | 7/2007 | Kerker et al. | | |
| 2004/0128895 | A1 * | 7/2004 | Trudel | | 40/761 |
| 2006/0042140 | A1 | 3/2006 | Frew | | |
| 2010/0154267 | A1 * | 6/2010 | Nip | | 40/799 |

* cited by examiner

*Primary Examiner* — Gary Hoge
(74) *Attorney, Agent, or Firm* — Cameron LLP

(57) ABSTRACT

A frame block for use in displaying typically flat planar rectangular objects such as photographs comprises two parallel planar areas, at least one such area having a plurality of grooves and associated ridges. The grooves and ridges each have a predetermined width and an associated length. The grooves are cut into a surface of the frame block and have a predetermined depth for receiving a clear plastic protector frame for an object to be displayed. The grooves and ridges form an area for display in which a two- or three-sided clear plastic protector frame may be mounted, each of which protects the object to the displayed. When standing on a side with the grooves horizontally aligned to said side, the frame block area is adapted to receive a three-sided protector and associated object at a location within the area selected by a user, two opposite sides of the three-sided protector being received into two horizontally aligned grooves. Similarly, when lying down, the frame block area is adapted to receive a two-sided protector frame and associated object at a location within the area selected by the user, one side of the two-sided protector being received in one groove.

20 Claims, 7 Drawing Sheets

HUMBOLDT MINI

100
PLAN
FIG. 1 (A)(2)
121 a
area
4½"
100
g
r
7/8"
1/8"
1/8"
7/8"
6 1/8"
FRONT ELEVATION
FIG. 1 (A)(I)
121 b
1 3/8"
115
110
105
121 a
d
SIDE ELEVATION

SCALE 0" 1" 2" 5"
HUMBOLDT MINI 100
105 (1)
FIG.1 (C)(2)
PLAN W 4X6 P.P.
100
110
FIG.1 (E)(2)
PLAN W 3X2 P.P.
100
115 (1)
FIG.1 (G)(2)
PLAN W 2X3 P.P.
100
125
126
121 a
128
123

AXON.
105 (1)
100
FIG.1 (C)(1)
4X6 PHOTO PROT.

120 a
110
FIG.1 (E)(1)
3X2 PHOTO PROT.

115 (1)
121 b
FIG.1 (G)(1)
2X3 PHOTO PROT.

SCALE 0" 1" 2" 5"
HUMBOLDT MINI

FIG. 1 (K)(2)
PLAN

FIG. 1 (K)(1)
SIDE ELEVATION

FRONT ELEVATION

HUMBOLDT MINI - FLAT 200
220 b
220 a
PLAN
FIG. 2 (A)(2)
200
g
area I
226
r
225
3¾"
220 a
228
227
5⅜"
6⅛"
7/8"
1/8"
1/8"
7/8"
FRONT ELEVATION
FIG. 2 (A)(I)
200
220 b
d
1⅜"
215
210
205
SIDE ELEVATION

SCALE
0"
1"
2"
5"
AMAZON MINI

300
PLAN
FIG.3 (A)(2)
g
r
3½"
3¾"
6⅛"
⅞"
300
FRONT ELEVATION
FIG.3 (A)(1)
1⅜"
315
310
305
300
d
SIDE ELEVATION

SCALE 0" 1" 2" 5"
SIERRA MINI

400
FIG. 4 (A)(2)
PLAN
400
g
r
FIG. 4 (A)(1)
FRONT ELEVATION
400
1 3/8"
415
410
405
d

SIDE ELEVATION
SCALE 0" 1" 2" 5"
AMAZON MINI UP 500
550 b
550 a
PLAN
FIG.5 (A)(2)
500
550 a
area 2
g
551
552
r
553
FRONT ELEVATION
FIG.5 (A)(1)
500
550 b
d
1 3/8"
530
525
520
515
510
505
550 a
SIDE ELEVATION

SCALE 0" 1" 2" 5"
SHENANDOAH LARGE

FRAME BLOCK FOR FLAT RECTANGULAR PLANAR OBJECTS SUCH AS PHOTOGRAPHS

TECHNICAL FIELD

The technical field of the several embodiments of a frame block relates generally to the field of frames for pictures and, more particularly, to embodiments thereof, for example, wherein, for example, photographs may be arranged to lie flat and be mounted by three-sided protectors to a standing frame block or upright in two-sided protectors to a frame block lying on a flat surface in an arrangement selected by the user.

BACKGROUND

Flat planar, typically, rectangular objects such as business cards, photographs, pictures, paintings and paper ephemera including collectibles such as autographs, stamps, coins, paper money or items of postal or other history are typically displayed in specially designed frames. The specially designed frames may have specially cut mats which frame each object within the frame. The mat is typically a decorative border of cardboard or similar material placed around the object to serve as a frame or act as a contrast between the object and the frame. Such mats and frames require custom preparation.

Wiener, U.S. Pat. No. 4,899,474, provides a picture frame assembly including a frame of molded plastic or other material defining a viewing window covered by a sheet of transparent glass or plastic. Per FIG. 1, a number of flat planar objects of various sizes and shapes may be displayed within the picture frame assembly. The frame assembly permits photos, pictures and/or documents to be inserted within for viewing through the transparent sheet.

Frew, U.S. Patent Application Publication US 2006/0042140, discloses a multi-picture frame apparatus and kit which incorporates a plurality of picture frames mounted on linear support members so that different sizes of pictures may be accommodated within the apparatus.

Kerker et al., U.S. Pat. No. 7,249,430, disclose a frameless display fixture comprising a self-supporting panel having recesses adapted to receive retail merchandise. In particular, the merchandise may be greeting cards of varying rectangular shape displayed whereby two panels of recesses form a triangular cross section with a support frame.

Ornamental design U.S. Patent Des. 329,942 issued to Glenda Carr for a framing block. The framing block appears to substantially comprise a cube having a cut-out in the top of the cube.

Each of the above-identified patents and patent applications should be deemed to be incorporated by reference herein as to their entire contents.

SUMMARY OF EMBODIMENTS AND ASPECTS

This summary is intended to introduce, in simplified form, a selection of concepts that are further described in the Detailed Description and depicted in the drawings. This summary is not intended to identify key or essential features of the claimed subject matter, nor is it intended to be used as an aid in determining the scope of claimed subject matter. Embodiments and aspects described herein relate generally to embodiments and aspects and methods of use of a frame block for permitting a user to adapt the frame block for displaying one or more flat planar rectangular objects in a manner selectable by the user via, for example, associated three-sided or two-sided clear protector frames. In particular, a frame block is provided with a plurality of horizontally aligned grooves and associated ridges, the grooves and ridges having predetermined width and the grooves having predetermined depth. For example, the frame block may comprise two parallel planar surfaces. One or both planar surfaces may comprise the horizontal grooves and associated ridges which grooves may be cut or otherwise manufactured to be approximately perpendicular to the planar surface. If one horizontal grove is substantially perpendicular to the planar surface in which it is cut, then, all horizontally parallel grooves should be similarly cut at the same substantially perpendicular angle. If slanted to an angle of between 0° and 20° to the perpendicular, then, all grooves will be slanted (cut) at the same angle into the frame block. If the two planar parallel surfaces have an axis that represent a depth of the frame block into which depth the grooves are cut, then, the distance in depth between the two parallel planar surfaces is less than maximum dimensions in either a height or width axis. For example, the depth distance may be on the order of one to two inches while a length and width of a frame block may be five times or ten times this distance respectively.

In an alternative embodiment, a plan view of a frame block, rather than comprising a rectangle, may comprise an equilateral triangle or a pentagon presenting three or five surfaces to a user for displaying pictures thereon. In such embodiments, the frame block may be hung from a ceiling as a mobile or displayed on a table top and rotated with one, two, three, four or as many as five sides for displaying flat rectangular objects such as photographs. In either a use as a mobile, hanging from a ceiling or if set on a flat surface, the horizontal grooves should be cut parallel to one another and to the ceiling or ground or table top on which it may sit.

Moreover, a frame block having a rectangular plan view may have one side with one or more flat rectangular objects mounted thereon. Such a frame block may have the opposite flat planar surface equipped with suitable hardware for hanging on a wall in a manner similar to a conventional picture frame.

A frame block embodiment may be laid down on a flat surface so that one planar surface having horizontally aligned grooves faces upward. The one planar surface facing upward may receive one or more two-sided protectors of a size selected for displaying an object. Such a two-sided protector fits in a horizontal groove at a location selected by the user so as to display, for example, a photograph at an angle or vertically. When laying down on a flat surface, a fiat planar object such as a photograph may be displayed by placing the object in a horizontal groove without a one or two sided protector. In such case, the object would preferably have a thickness less than the width of a horizontal groove and the horizontal groove deep enough to hold and display the object.

Alternatively, the embodiment may be made to stand on a flat surface such that one or both planar surfaces having the horizontally aligned grooves face outward whereby the horizontal, parallel grooves are adapted to compressively receive one or more three-sided clear protector frames. The three-sided clear protectors have a flat protector side and two perpendicular flaps slanted towards one another which are biased to grasp corresponding edges of the horizontally aligned grooves of predetermined width, wider than the narrower flaps. For example, a photograph may be displayed within the protector mounted in the horizontal grooves at a location selected by the user and vertically oriented so that the photograph is viewable with the frame block standing as with the use of the frame block with a two-sided protector where the protector is standing and the frame block lying down. In such a manner, the frame block may be variously sized and shaped and provided with a varying number of grooves such that the frame block may display many objects in an arrangement selected by the user.

For example, a two-sided or three-sided clear, for example, plastic, acrylic, recycled clear content material or resin protector frame may be sized for typical photographic sizes such as 2" by 3", 3" by 2", 3" by 5", 4" by 6", 6" by 4", 7" by 5" or 5" by 7" among other sizes. The frame block may be as large as or even larger than three feet wide by three feet high with as many as thirty or more horizontally aligned parallel grooves in at least one flat planar surface for receiving two- or three-sided clear protectors and associated objects. The three foot by three foot frame block may be thin for mounting to a wall or thick, for example, 8" thick and be free-standing. Alternative frame block embodiments may be designed to have varying shapes which are ornamental in nature and may, by some, be considered works of art in their design. For example, a frame block need not stand perfectly upright but may be slanted slightly from the vertical and so display a photograph at an angle similar to an application as a table picture frame. Moreover, the user will be an artist in selecting and designing their application of two or three-sided clear protectors for objects of varying sizes for mounting in the horizontally aligned grooves of the frame block.

In accordance with one embodiment, the horizontally aligned grooves may be provided in such a manner that one plurality of horizontally aligned grooves may be spatially separated from another plurality of horizontally aligned grooves. A choice of location of a protector may be limited to only the arrangement of horizontally aligned grooves that are provided in this frame block embodiment. Nevertheless, the arrangement, for example, of seven horizontally aligned grooves spatially separated from another fifteen horizontally aligned grooves will provide flexibility for mounting at least two different sizes of three-sided clear protectors. Moreover, the spatial separation of the two sets of horizontally aligned grooves provides an ornamental feature that is different from the feature of providing a single collection of, for example, twenty-two or, for example, thirty horizontally aligned grooves forming a contiguous area for mounting protector frames and associated objects.

The frame block may be made of wood, for example, Forest Stewardship Council (FSC) certified cherry, maple or mahogany woods. The frame block may be made of scrap, reclaimed solid stock wood or, in some embodiments, plywood, preferably of better quality for finishing. The frame block may be constructed of metal of various types such as brass, silver, copper or stainless steel. The frame block may be constructed of plastic or acrylic or acrylic resin. Preferably, the plastic or acrylic may be of one color or many colors. Moreover, the wood may be finished in natural tones or painted, for example, in enamel. It is not inconceivable that a frame block may be constructed of stone, such as marble or granite, or simulated stone or wood substance. Moreover, it is possible to construct a frame block of ceramics, crystal or cut glass.

In one embodiment, the clear protector frame, either two or three sided, may exceed the size of the surface to which it is mounted. In such an embodiment, a small frame block may provide a support for a larger clear plastic protector frame.

These and other embodiments and aspects will now be described with reference to the drawings and the detailed description to follow.

BRIEF DESCRIPTION OF THE DRAWINGS

FIG. 1(A)(2) is a plan view; FIG. 1(B)) is a side elevation view; FIG, 1(C)(1) is a front elevation view with a 4" by 6" clear plastic protector mounted in top and bottom horizontally aligned grooves; FIG. 1(C)(2) is a plan view thereof and FIG. 1(D) is a side elevation view thereof; FIG. 1(E)(1) is a front elevation view of the Humboldt with one 3"×2" clear plastic protector mounted from the top groove where FIG. 1(E)(2) is a plan view and FIG. 1(F) is a side elevation view thereof; FIG. 1(G)(1) is a front elevation view of the Humboldt with one 2"×3" clear plastic protector mounted from the top groove where FIG. 1(G)(2) is a plan view and FIG. 1(H) is a side elevation view thereof; FIG. 1(I) is a perspective view of the Humboldt; FIG. 1(J) is a front elevation view of a Humboldt laid flat on a surface with a two-sided protector mounted in the fifth groove from one side where FIG. 1(K)(1) is a side elevation view and FIG. 1(K)(2) is a plan view thereof.

FIG. 2(A)(2) is a plan view; FIG. 2(B)) is a side elevation view showing three different three-sided clear protectors that may be used with the Amazon among others including two-sided clear plastic protectors as shown in FIG. 1(J) and (K).

FIG. 3(A)(2) is a plan view; FIG. 3(B)) is a side elevation view showing three different three-sided clear protectors that may be used with the Sierra among others including two-sided clear plastic protectors as shown in FIG. 1(J) and (K).

FIG. 4(A)(2) is a plan view; FIG. 4(B)) is a side elevation view showing three different three-sided clear protectors that may be used with the Amazon among others including two-sided clear plastic protectors as shown in FIG. 1(J) and (K).

FIG. 5(A)(2) is a plan view; FIG. 5(B)) is a side elevation view showing six different three-sided clear protectors that may be used with the Amazon among others including two-sided clear plastic protectors as shown in FIG. 1(J) and (K).

DETAILED DESCRIPTION OF THE EMBODIMENTS

Figure 1:
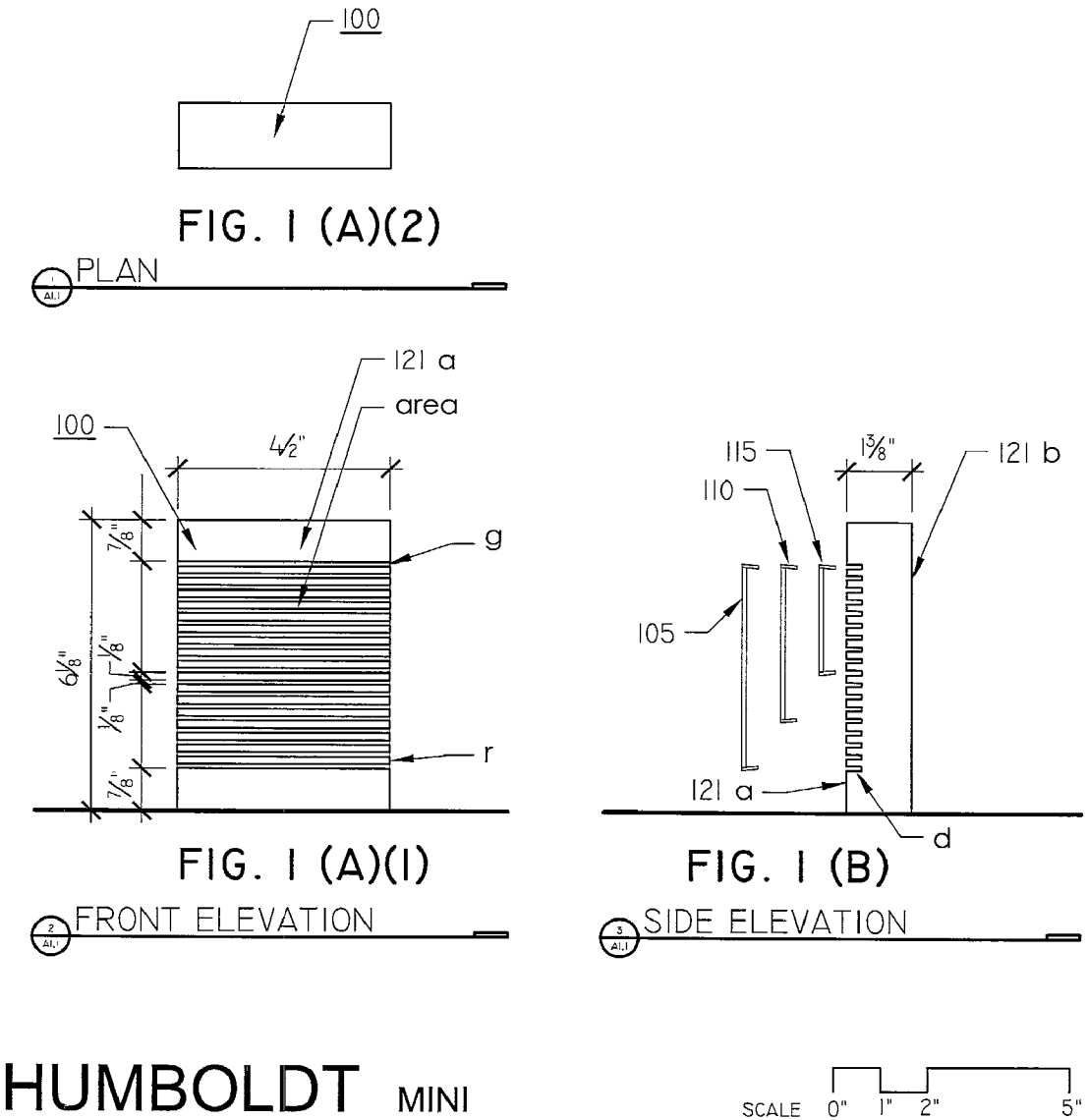
FIG. 1 shows an embodiment of a frame block named the Humboldt embodiment in which FIG. 1(A)(1) is a front elevation view.
Figure 1:
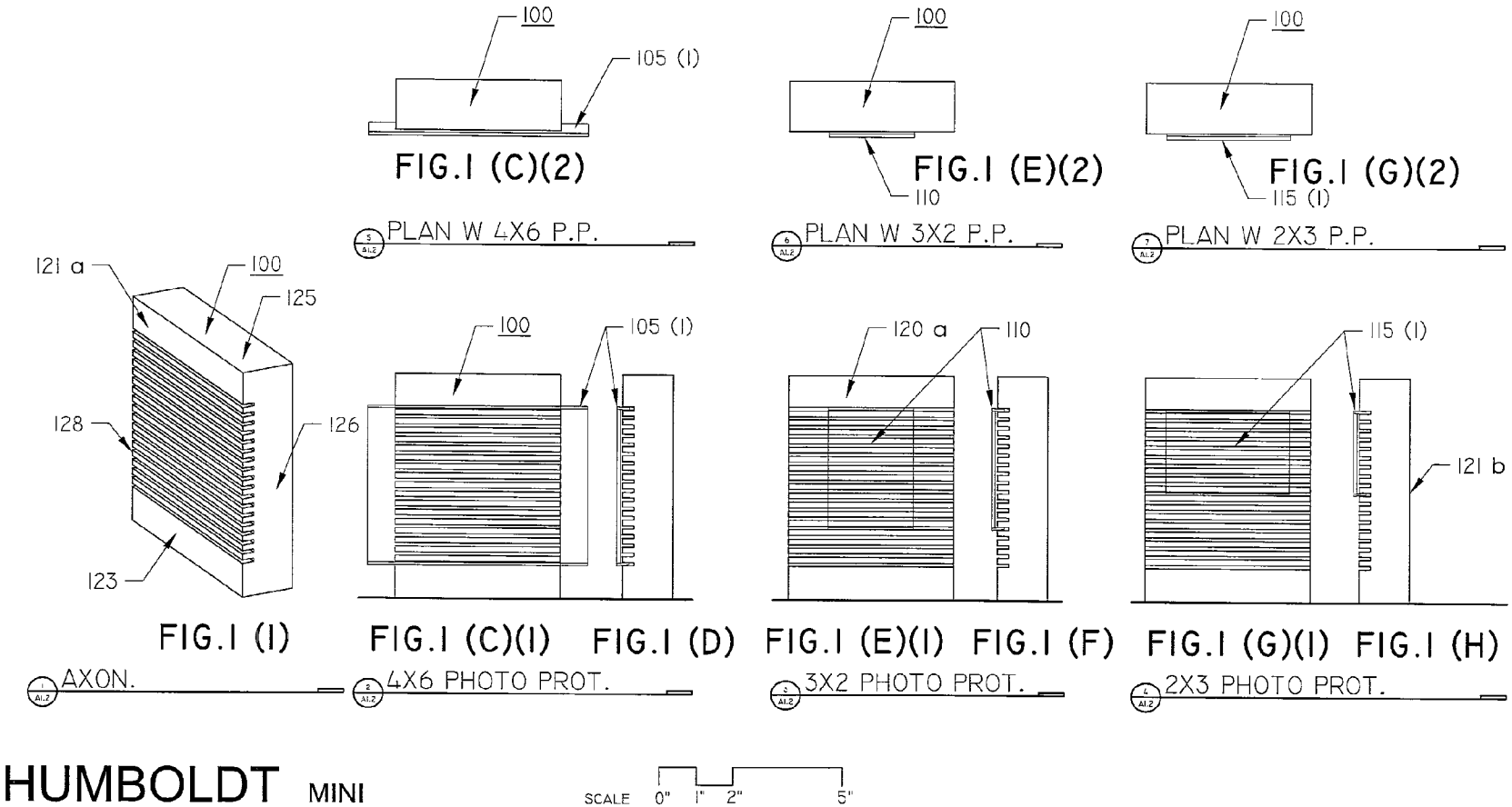
Figure 1:
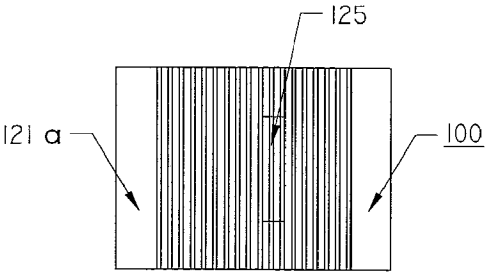
Figure 1:
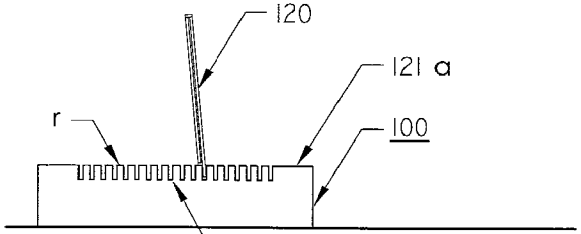
Figure 1:
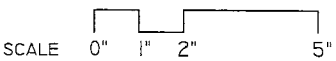
Figure 1:
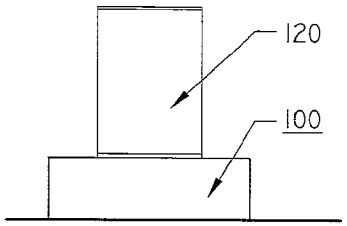

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. FIG. 1 shows an embodiment of a frame block named the Humboldt embodiment 100. A typical dimension of one embodiment may be 4½ inches wide by 6⅛" high and 1⅜" deep where one or both of two parallel flat surfaces 121*a*, 121*b* shown in FIG. 1(B) may be provided with parallel horizontally aligned grooves and corresponding ridges where the ridges r are 5/32" wide and the grooves are 3/32" wide. The horizontally aligned grooves are preferably in a plane approximately parallel to the plane of a ceiling, from which a frame block may hang, the floor, a table top on which it may sit and, if hung from a wall in a manner similar to a conventional wall picture frame, then, perpendicular to the plane of gravity (i.e. level).

Dimensions provided herein are provided by way of example and dimensions may vary depending on the application or desired design. For example, there may be frame blocks having a wider groove of, for example, ½" or even wider to display a particularly large rectangular flat object. Referring briefly to FIG. 1(I), the frame block 100 may have four sides 125, 126, 127 and 128. In the Humboldt, all four sides 125, 126, 127 and 128 may be perpendicular to one another and form a rectangular box shape with parallel planar surfaces 121*a* and 121*b*. Side 127 is parallel to horizontally aligned grooves when the Humboldt is standing on side 127 as per FIG. 1 (I). Other embodiments than the Humboldt may be constructed of four sides but having only two sides perpendicular to one another (the Amazon 200, FIG. 2(A)(1), sides 226 and 227 of four sides 225, 226, 227 and 228. All dimensions herein are exemplary and may be varied from embodiment to embodiment depending on design choice or for ornamental considerations. The 1⅜" deep, for example, is representative. To stand without falling easily, frame block 100, being approximately 6" high, should be approximately ¾" deep and may be as deep as 2½." It is possible in one large embodiment that a frame block may be as deep (thick) as 8". The grooves may have a depth d of 5/16". Again, grooves may have a depth of ½" or more, depending on the object to be displayed. The groove depth d may be sufficiently deep to receive the bottom edge of a two-sided frame protector per FIG. 1(K)(1) and hold the protector in place. The depth d may likewise be sufficiently deep to receive a biased three-sided protector 105, 110, 115, for example, as seen in FIG. 1(D) or 1(F). So a range for the groove depth d may be approximately 3/16" to ½" deep. Per FIG. 1(B), the grooves g may support a number such as three or more differently sized three-sided clear plastic protectors 105, 110 and 115 which may be mounted anywhere within the area area of parallel horizontally aligned grooves g and associated ridges r shown in FIG. 1(A)1. The area area may comprise, for example, eighteen parallel horizontally aligned grooves g of depth d as seen in FIGS. 1(B) and 1(D). In an alternative embodiment the grooves g and associated ridges r may be provided in groups or sets, for example, a plurality of seven grooves spatially separated from a group of four grooves within different areas (not shown) of the same area area. Thus, one area of a plurality of seven grooves and associated ridges may be spatially separated from a second area of four grooves and associated ridges and a space shown occupied by seven remaining (18–11 equals 7) grooves g and associated ridges r remains uncut. All reference numerals herein are used to denote similar elements in the figures where the first numeral of the reference numeral indicates the figure in which the element first appears.

FIG. 1(A)(1) is a front elevation view showing area area, parallel horizontally aligned grooves g and corresponding horizontal ridges r. The area area may be selectively used be a user to mount rectangular flat planar objects, for example, photographs in a manner that is user selectable. FIG. 1(A)(2) is a plan view of the Humboldt 100. The plan view forms a rectangle and as can be seen, the Humboldt 100 has four sides. Such an embodiment may he hung in a similar manner as a wall picture frame from a vertical wall of a structure.

In alternative embodiments, the Humboldt may have four sides of equal length and so be of square cross-section. In alternative embodiments such as one of square plan view cross-section, all four sides may be provided with horizontally aligned grooves. The cross-section may be triangular comprising an equilateral triangle or pentagonal with sides of equal width. Such embodiments may be hung as a mobile from a ceiling or be free-standing.

FIG. 1(B)) is a side elevation view showing a typical width of 1 ⅜" between flat planar surfaces of the Humboldt and groove depth d of 5/16", Again, all dimensions provided herein are exemplary and may vary from design to design or from application to application. Three sided-protector frames 105, 110, 115 are shown with two narrow flaps which are slanted towards one another to grasp wider grooves in which they are mounted. FIG. 1(C)(1) is a front elevation view with a 4" by 6" clear plastic protector 105(1) mounted in top and bottom horizontally aligned grooves. The three-sided clear plastic protector 105(1) extends beyond the sides (FIG. 1(I): 126, 128) of the Humboldt 100 when standing in this view. A two-sided or three-sided protector frame 105, 110, 115, 120 may be larger or smaller than the width of the embodiment in which it is mounted. The three-sided clear plastic protector 105, 110 or 115 having flaps slanted towards one another is biased to be retained in and grasp the edges of the two grooves g in which it is mounted. The three-sided clear plastic protector 105, 110 or 115 is further provided with sufficiently long opposing sides as to be semi-permanently mounted so as to protect an object between its inner surface and the groove surface area of area area of the embodiment in which it is mounted. FIG. 1(C)(2) is a plan view of Humboldt showing the large three-sided protector 105-1 mounted in the grooves g of the Humboldt. FIG. 1(D) is a side elevation view of the large three-sided protector 105-1 mounted in the grooves of the Humboldt.

FIG. 1(E)(1) is a front elevation view of the Humboldt with one three-sided 3"×2" clear plastic protector 110 mounted from the top groove and the fourteenth groove from the top groove. Again, the three-sided 3"×2" clear plastic protector 110 may be mounted anywhere in area area. FIG. 1(E)(2) is a plan view showing the mounted three-sided 3"×2" protector and FIG. 1(F) is a side elevation view thereof.

FIG. 1(G)(1) is a front elevation view of the Humboldt with one three-sided 2"×3" clear plastic protector 115(1) mounted from the top groove to the tenth groove down from the top groove, where FIG. 1(G)(2) is a plan view and FIG. 1(H) is a side elevation view thereof. Again, the three-sided 2"×3" clear plastic protector 115-1 may be mounted anywhere in area area. Mounting in the center from the top groove is only shown by way of example. The user may select where to place the protector 115-1 and associated object it protects, for example, two rows down from the top or mounted towards a side.

FIG. 1(I) is a perspective view of the Humboldt with one flat parallel surface 121*a* having parallel horizontally aligned grooves g. In an alternative embodiment not shown, both a front planar surface 121*a* and a rear planar surface 121*b* parallel to the front planar surface may be provided with horizontally aligned grooves g (not shown) in differently sized or the same sized areas area. Moreover, some rows of parallel horizontally aligned grooves g and ridges r may be eliminated for ornamental purposes. For example, there may be four rows of grooves at a top and six rows of grooves at a bottom, spatially separated by an empty area (not shown).

FIG. 1(J) is a front elevation view of a Humboldt laid flat on a surface with a two-sided clear plastic protector 120 mounted in the fifth groove from one side where FIG. 1(K)(1) is a side elevation view showing the protector 120 mounted in the fifth groove. Flat planar surface 121*a* is facing up while the Humboldt 100 is lying down on a flat planar surface, for example, a table or desk top. FIG. 1(K)(2) is a plan view thereof. While the fifth groove from one side is selected for this drawing, another groove g may be selected by a user. Moreover, while the protector 120 is shown toward the center of a horizontally aligned fifth groove g, the user may select to mount the protector and associated object to one side or the other of center. Moreover, although not shown, the protector 120 may extend beyond the sides of the Humboldt while lying down (not shown).

Figure 2:
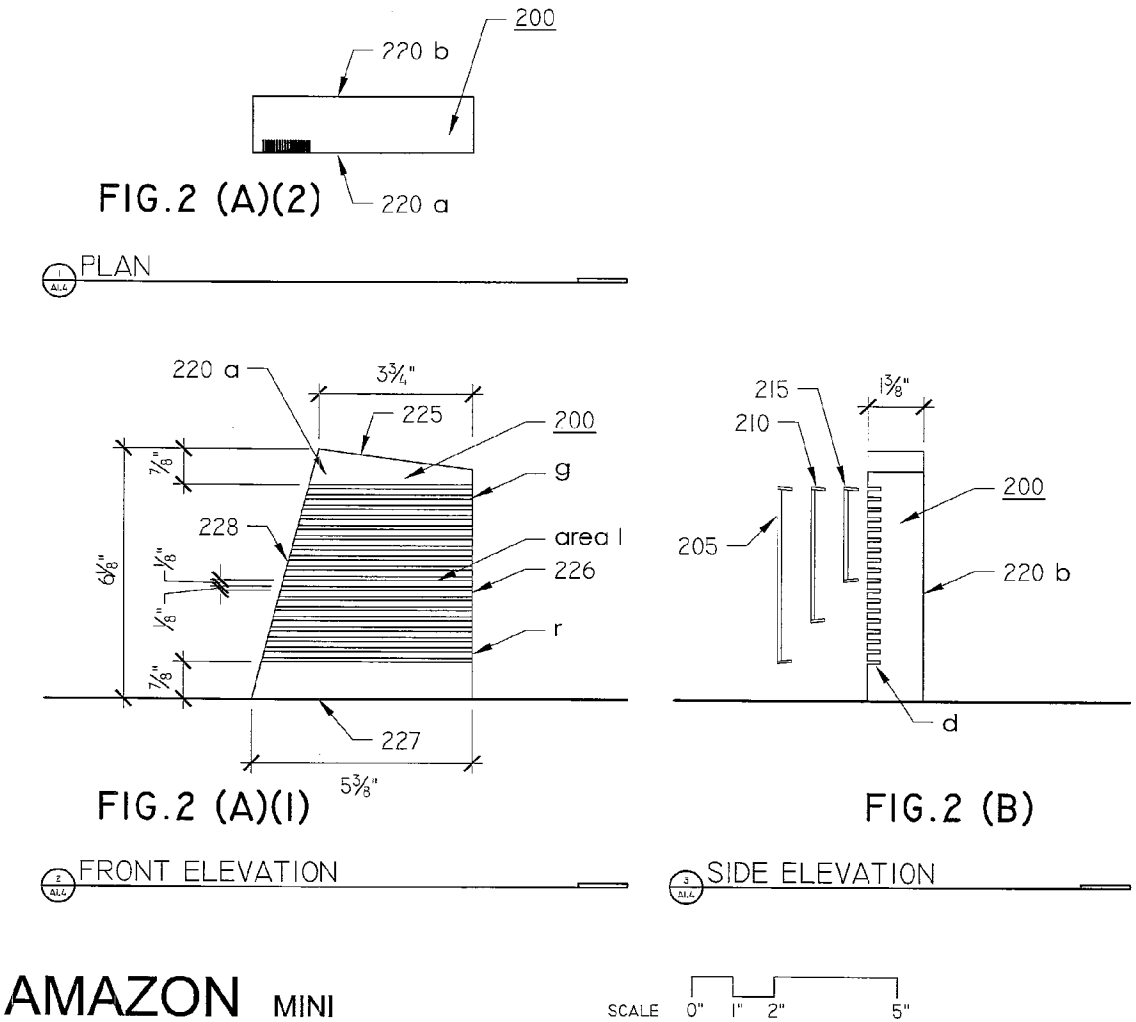
FIG. 2 shows an embodiment of a frame block named the Amazon embodiment in which FIG. 2(A)(1) is a front elevation view.
Figure 4:
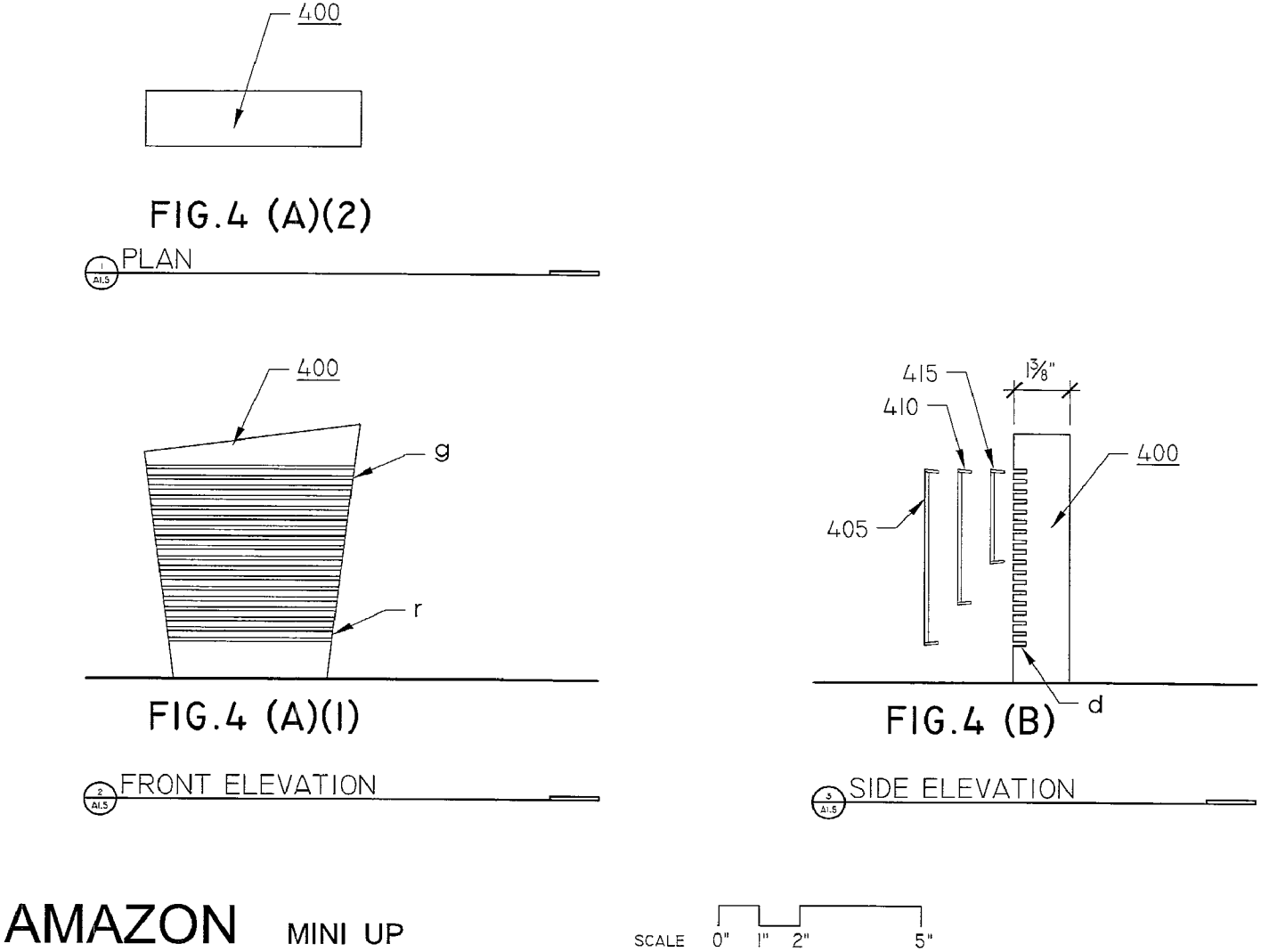
FIG. 4 shows an embodiment of a frame block named the Amazon up embodiment in which FIG. 4(A)(1) is a front elevation view.

Referring to FIGS. 2 and 4 there are shown alternative Amazon embodiments 200, 400 which may be shaped variously from the embodiment of the Humboldt. The Amazon embodiment of FIG. 2 comprises one right angle of 90° between sides 226 and 227 of sides 225, 226, 227 and 228. The Amazon up of FIG. 4 has four sides but no right angles.

FIG. 2 shows an embodiment of a frame block 200 named the Amazon mini embodiment in which FIG. 2(A)(1) is a front elevation view. The Amazon mini has a top width of 3¾" and a bottom width, for example, of 5⅜". It is 6⅛" high, by way of example. Again, these dimensions are representative and may vary, for example, be proportionately larger or smaller and have similar angles between sides 225, 226, 227 and 228. As before, there are shown horizontally aligned grooves g and ridges r forming an area area1 different from area area of FIG. 1 on flat planar surface 220*a* which is parallel to flat planar surface 220*b*. FIG. 2(A)(2) is a plan view. FIG. 2(B)) is a side elevation view showing three different three-sided clear protectors 205, 210 and 215 that may be used with the Amazon among others including two-sided clear plastic protectors as shown in FIG. 1(J) and (K). When using the two-sided protector, the Amazon is laid down on a flat surface with surface 220*a* exposed for receiving a two-sided protector. With three-sided protectors, the Amazon is standing, for example on side 227 which is parallel to the horizontally aligned grooves g. Moreover, as per FIG. 1, the protector frame 205, 210 or 215 may extend beyond the sides of the Amazon 200 or be arranged anywhere within area area1.

Figure 3:
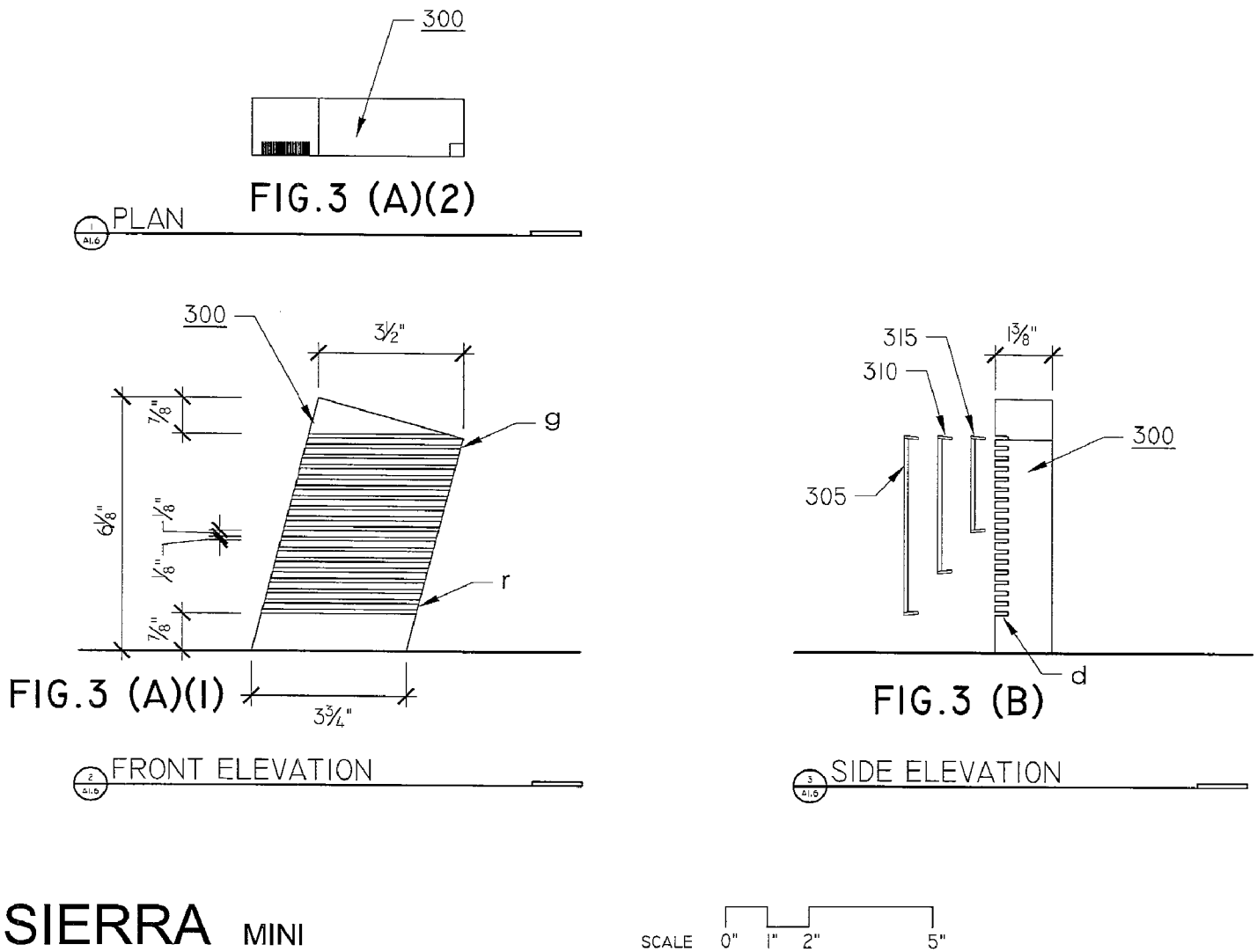
FIG. 3 shows an embodiment of a frame block named the Sierra embodiment in which FIG. 3(A)(1) is a front elevation view.

FIG. 3 shows an embodiment of a frame block named the Sierra mini embodiment 300 in which FIG. 3(A)(1) is a front elevation view. The Sierra has a top width, for example, of 3½" and a bottom width of 3⅜". It is 6⅛" high like the Amazon of FIG. 2. As indicated before, the various embodiments may be variously sized and the present dimensions are given by way of example. Grooves g and ridges r are shown and comprise yet a different area. Grooves g are cut perpendicular to the surface and have a predetermined depth d as shown in FIG. 3(B) which, again, may be 5/16". FIG. 3(A)(2) is a plan view. FIG. 3(B)) is a side elevation view showing three different three-sided clear protectors 305, 310 and 315 that may be used with the Sierra among others including two-sided clear plastic protectors as shown in FIG. 1(J) and (K) where the Sierra is laid down on a flat surface.

FIG. 4 shows an embodiment of a frame block named the Amazon up embodiment in which FIG. 4(A)(1) is a front elevation view showing grooves g of predetermined spacing from one another and ridges r of predetermined width, for example, the same width as ridge r of the Humboldt. FIG. 4(A)(2) is a plan view. FIG. 4(B)) is a side elevation view showing three different three-sided clear protectors 405, 410 and 415 that may be used with the Amazon among others including two-sided clear plastic protectors as shown in FIG. 1(J) and (K) where the Amazon may be laid down on a flat surface. Also, the Amazon may be provided with grooves and ridges on both parallel sides (not shown) having the same or different areas.

Figure 5:
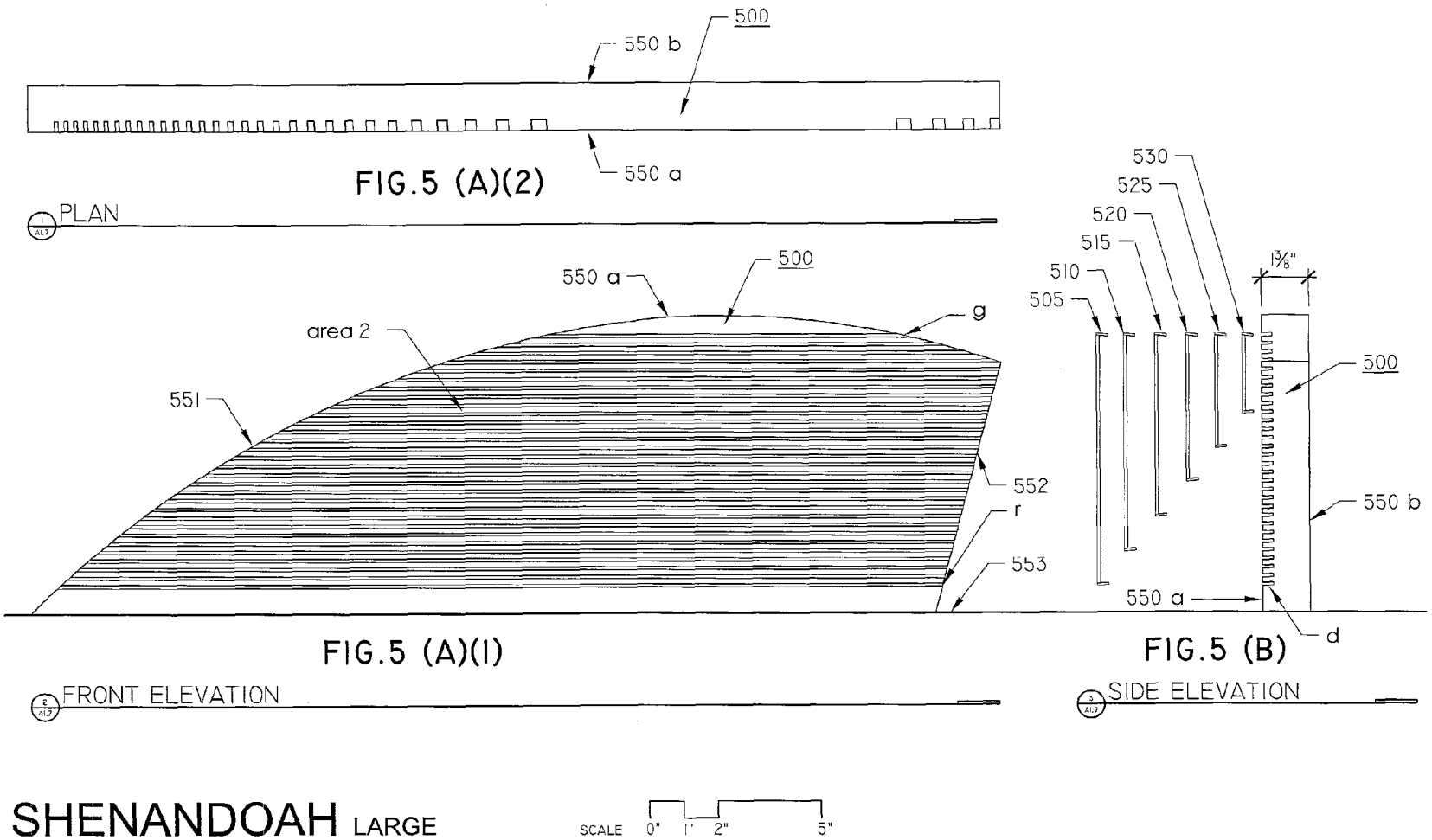
FIG. 5 shows an embodiment of a frame block named the Shenandoah embodiment in which FIG. 5(A)(1) is a front elevation view.

FIG. 5 shows an embodiment of a frame block named the Shenandoah embodiment. The Shenandoah is equipped with a curved side 551 and so is three sided. It has two parallel planar surfaces 550*a* and 550*b*. The side on which it sets when standing is side 553. There is a third side 552 which joins curved sided 551 and side 551. While its dimensions are not shown, the Shenandoah may be representative of the largest frame block on which a grooved surface may display many photographs or objects in selected locations of area area2. FIG. 5(A)(1) is a front elevation view showing no protector frames mounted thereon wherein front planar surface 550*a* may be seen and curved side 551 and straight sides 552, 553 of three sides total. It is not outside the scope of the Shenandoah embodiment whereby a single curved side 551 may be designed to surround a single flat side 553 on which the Shenandoah may stand. Thus, an embodiment of the Shenandoah may have one curved side 551 and one straight side 553 and, thus be two-sided. FIG. 5(A)(2) is a plan view in which the depth d of the grooves may be seen. The depth d may be the same as that of the Humboldt and within the same range. FIG. 5(B)) is a side elevation view showing six different three-sided clear protectors 505, 510, 515, 520, 525 and 530 that may be used with the Shenandoah among others including two-sided clear plastic protectors as shown in FIG. 1(J) and (K). The two-sided clear plastic protectors may be of various sizes and stand up-right within area area2 with the Shenandoah laying down on a flat surface with area2 facing up. If standing, the Shenandoah may be provided with both flat planar surfaces 550*a* and 550*b* cut with horizontally aligned grooves g to receive two- or three-sided clear plastic protectors of different sizes suited for the objects to be displayed.

The principles of application of the several discussed embodiments of a frame block for, for example, receiving two-sided protector frames or three-sided protector frames may be extended to other embodiments or various shapes and sizes such as for mounting other objects of different shapes. For example, while a plurality of horizontally aligned grooves and ridges are shown, the various embodiments may be provided with a plurality of concentric circular grooves and ridges replacing the parallel horizontally aligned grooves. Clear plastic protector circular frames may have circular sides and have different diameters for fitting various sized circular objects, for example, coins. A concentric circular area may be proximate to an area formed of horizontally aligned grooves and ridges for displaying, for example, coins and paper money. The principle may be extended to a plurality of concentric oval shapes for oval-shaped pictures or cameos. All these shapes of clear plastic protectors may be used together on the same frame block in combination with particularly designed grooves to accommodate the protectors. These and other features of embodiments and aspects of a frame block and protector frame assembly may come to mind from reading the above detailed description, and any claimed invention should be only deemed limited by the scope of the claims to follow.

What I claim is:

1. A frame block for use in displaying objects, the frame block comprising an area of a plurality of horizontal grooves and associated ridges of a planar surface of the frame block, the horizontal grooves having predetermined width of greater than 1/16 inch and predetermined depth and the ridges having predetermined width, first and second parallel, horizontal grooves for receiving a narrower clear protector frame configured for protecting and holding an object to be displayed, the frame block having two substantially parallel planar surfaces and at least two sides, one planar surface for said area of horizontal grooves and associated ridges parallel to one another, the grooves being substantially perpendicular to the one planar surface and extending the predetermined depth into the one planar surface, the first and second parallel, horizontal grooves for receiving said protector frame, the protector frame configured to cover and protect the object to be displayed, the clear protector frame having three sides: a first front planar side and first and second opposing flaps slanted towards one another and configured to grasp corresponding edges of the first and second parallel, horizontal grooves of the frame block, the first front planar side of the clear protector frame configured to cover and to protect the object among its inner surface, the planar surface groove and ridge area of the frame block and the first and second opposing flaps of the clear protector frame, the first and second opposing flaps being slanted towards one another and having corresponding lengths abutting corresponding lengths of the first front planar side of the clear protector frame, the first and second opposing flaps of the clear protector frame configured to semi-permanently mount the object by biasing the first and second opposing, slanted flaps of the clear protector frame for grasping the corresponding edges of and for retention in first and second respective parallel grooves of the planar surface groove and ridge surface area of the frame block.

2. The frame block as recited in claim 1, the horizontal grooves of the frame block being horizontally aligned when the frame block is standing on a flat planar horizontal surface, the horizontal grooves being aligned with a side of the frame block on which the frame block stands, the protector frame being constructed of clear plastic with the first front planar side adapted to be biased for reception and retention of the opposing, first and second flaps slanted towards one another in first and second horizontally aligned grooves of the planar surface ridge and groove area of the frame block and to cover and protect a flat planar object for display on said standing frame block.

3. The frame block as recited in claim 2, the three-sided clear plastic protector frame having a smaller width than a width of the frame block, the frame block for receiving a plurality of clear three-sided plastic protector frames in the planar surface groove and ridge area of the frame block and associated objects for display within each three-sided plastic protector frame.

4. The frame block as recited in claim 2, the three-sided clear plastic frame having a larger width than the frame block, the frame block for receiving one three-sided clear plastic frame and associated object.

5. The frame block as recited in claim 2, the surface area of a plurality of horizontally aligned grooves and ridges of the frame block comprising two areas spatially separated from one another, each having a plurality of horizontally aligned grooves and ridges different in number from one another.

6. The frame block as recited in claim 2 having a large surface area for grooves and associated ridges of the frame block for mounting and retaining a plurality of biased three-sided clear plastic protector frames and associated objects in an arrangement selected by a user.

7. The frame block as recited in claim 2 for accommodating one of a 2" by 3", a 3" by 2", a 3" by 5", a 4" by 6", a 6" by 4", a 5" by 7" and a 7" by 5" clear plastic three-sided protector configured to protect flat rectangular objects of similar size.

8. The frame block as recited in claim 1, the horizontal grooves of the frame block being horizontally aligned when the frame block is lying down on a flat planar surface, another protector frame having two sides and one side being constructed of clear plastic and the other side being sized and configured to fit in a groove so as to be slanted at an angle to the perpendicular of the frame block, the horizontal groove of the frame block having a predetermined width greater than 1/16 inch and the two sides of the two-sided protector frame together configured to protect a flat planar object for display on a lying down frame block.

9. The frame block as recited in claim 8 having a large planar surface area for grooves and associated ridges for mounting and receiving a plurality of slanted two-sided clear plastic protector frames and associated objects in an arrangement selected by a user.

10. The frame block as recited in claim 8 further comprising a clear plastic two-sided protector frame for use in protecting said object to be displayed and having one of a rear side and a front side that is at a predetermined angle greater than 90 degrees and slanted in relation to a depth direction of the groove of predetermined width in which it is to be received.

11. The frame block as recited in claim 1 having three sides and two parallel planar surface areas, one parallel planar surface area for receiving a three-sided clear plastic protector, one of said three sides of said three-sided clear plastic protector being flat and two flaps of said three sides being slanted flaps for biased reception in the first and second parallel, horizontal grooves of the frame block, said one planar surface area of grooves and ridges and the first and second parallel, horizontal grooves for compressively receiving a biased three-sided clear plastic protector being substantially the entire area of said one parallel planar surface area.

12. The frame block as recited in claim 1, said planar area of grooves and associated ridges of the frame block further comprising a first area of grooves and associated ridges and a second area of horizontally aligned grooves and associated ridges.

13. The frame block as recited in claim 1 further comprising a clear plastic three-sided protector frame for use in protecting said object to be displayed and for biased and compressive mounting in two of a plurality of horizontally aligned grooves of said predetermined width.

14. The frame block as recited in claim 1 comprising one of wood, metal and acrylic.

15. The frame block as recited in claim 14, wherein two sides of the four sides of the frame block form a right angle to one another.

16. The frame block as recited in claim 14, wherein no sides of the four sides of the frame block form a right angle to one another.

17. The frame block as recited in claim 14, wherein all four sides of the frame block form a right angle to one another.

18. The frame block as recited in claim 1 having first and second parallel planar surfaces and four sides, the parallel, horizontal grooves of said predetermined width being horizontally aligned with one of said four sides on which said frame block sits when standing.

19. The frame block as recited in claim 1 comprising cherry, maple or mahogany woods or solid stock wood and the three-sided protector frame comprising clear material.

20. A method of mounting a flat planar object to a frame block for display, the method comprising standing said frame block on a side, the frame block having one of two flat planar surface areas cut with an area of horizontally aligned grooves of predetermined length, predetermined width greater than 1/16 inch and depth and associated ridges of predetermined width and associated length on one flat planar surface, the horizontally aligned grooves being parallel to the plane of the side on which the frame block is standing, placing a flat planar object in a three-sided clear plastic protector comprising a flat planar side and two opposing flaps, slanted towards one another and biased for grasping edges of parallel grooves of the frame block of the predetermined width; and mounting said three-sided clear plastic protector with said flat planar object to said area of horizontally aligned grooves by aligning and fixing the slanted, biased two opposing sides of said three-sided clear plastic protector to grasp edges of associated grooves of predetermined width in said area at a location selected by a user.

* * * * *